US005564510A

United States Patent [19]

Walter

[11] Patent Number: 5,564,510

[45] Date of Patent: Oct. 15, 1996

[54] PNEUMATIC DRILL HAMMER

[76] Inventor: Hans-Philipp Walter,
Richard-Wagner-Strasse 5, D-74251
Lehrensteinsfeld, Germany

[21] Appl. No.: 356,003

[22] Filed: Dec. 14, 1994

[30] Foreign Application Priority Data

Dec. 15, 1993 [DE] Germany ..... 9319223 U

[51] Int. Cl.[6] ..... E21B 4/14; F01L 15/00

[52] U.S. Cl. ..... 175/296; 173/73; 173/80

[58] Field of Search ..... 175/293, 296, 175/297; 173/73, 80, 78, 131

[56] References Cited

U.S. PATENT DOCUMENTS

| | | | |
|---|---|---|---|
| 2,996,131 | 8/1961 | Greenwood | 175/293 |
| 3,570,611 | 3/1971 | Riziuc | 175/296 |
| 4,084,647 | 4/1978 | Lister | 173/73 |
| 4,312,412 | 1/1982 | Pillow | 173/73 X |
| 4,878,550 | 11/1989 | Chuang | 175/296 |
| 5,107,944 | 4/1992 | Gustaffsson | 175/296 |
| 5,207,283 | 5/1993 | Lay | 175/296 |
| 5,305,837 | 4/1994 | Johns et al. | 175/296 X |
| 5,318,140 | 6/1994 | Ekwall et al. | 175/296 |

FOREIGN PATENT DOCUMENTS

| | | |
|---|---|---|
| 484672A1 | 5/1992 | European Pat. Off. . |
| 2062690 | 3/1972 | Germany . |
| 2705191 | 8/1977 | Germany . |
| 9202336 | 6/1992 | Germany . |

*Primary Examiner*—Frank Tsay
*Attorney, Agent, or Firm*—Lowe, Price, LeBlanc & Becker

[57] ABSTRACT

According to the invention, a drill hammer (10) generally comprises an outer tube (55), a control casing jacket (60) inclusive of check valve (59) and a central tube (80) having radial passages (81, 83). A ram (75) is guided on central tube (80), onto the lower and preferably recessed end (84) of which the head of a drill steel (90) may slide. A cylinder liner (70) that may be provided with outer ribs (101) also guides ram (75) and is peripherally welded to outer tube (55) along a welding zone S of axial length l. Above control casing jacket (60), there is an adapter (40) comprising downstream channels (43) and carrying a blowing collar (50) provided with upwardly directed nozzles (53). A drive-transmitting sleeve (15) below a screw head (11) is joined to the adapter (40) either directly or via a shift unit (30) that guides a shaft (20) whose lower end (23) may form a slide valve relative to an upper adapter portion (41). From there, passages (42, 47) lead to a control casing jacket (62) having channels (63). Below a tubular body (61), there is between outer tube (55) and cylinder liner (70) a jacket chamber (68) of a free cross section at least as large as that of the narrowest among central passages (12, 22, 32, 42/47, 62, 82, 92) in the main components of the hammer, including the screw head (11), a shaft (20), a shift unit (30), an adapter (40), a tubular body (61), the central tube (80), and a shaft and the drill steel (87/90) of the drill hammer (10). Grooves, channels and bores (71, 72; 81, 83) in cylinder liner (70) and central tube (80) serve, together with recesses (76, 76') and bores (78, 78'), for controlling the movement of the ram (75).

28 Claims, 8 Drawing Sheets

Figure 1A:
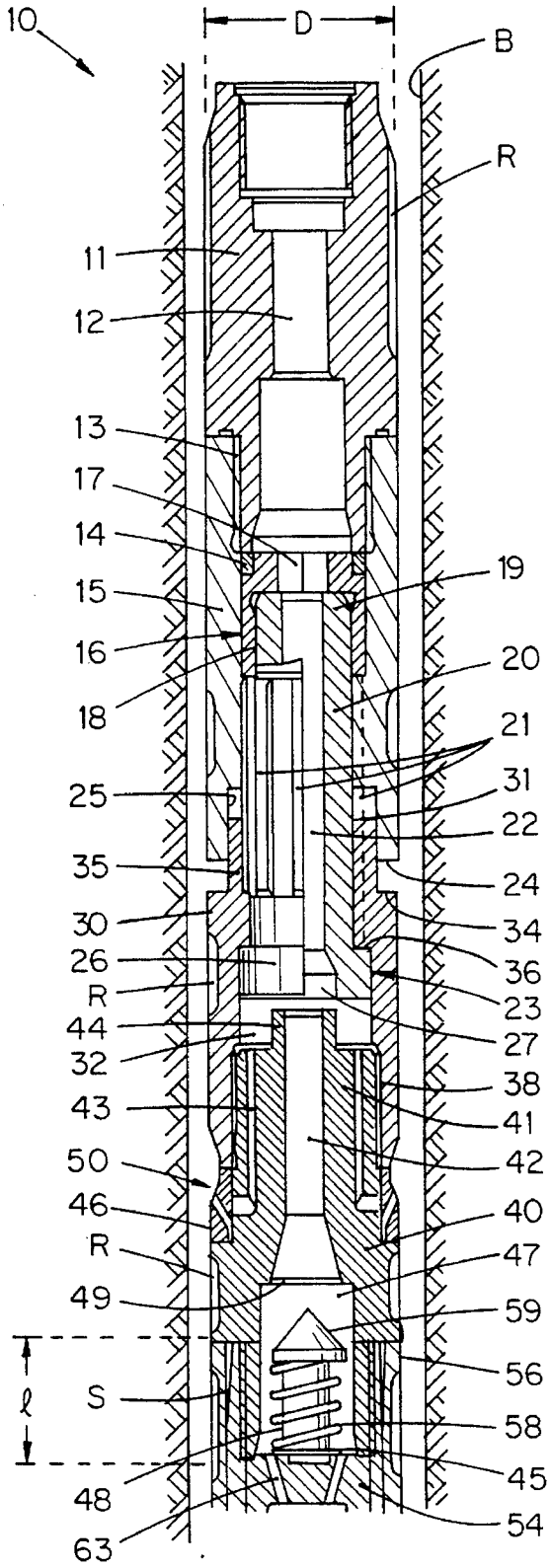

Fig. 5a
Fig. 5b
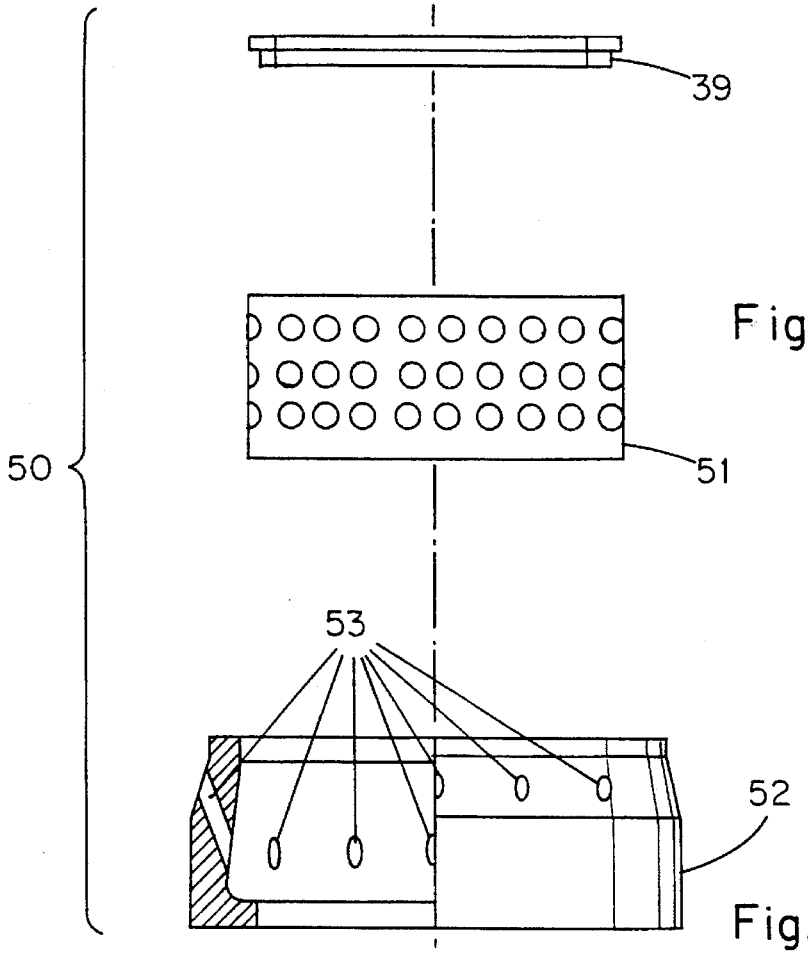
Fig. 5c
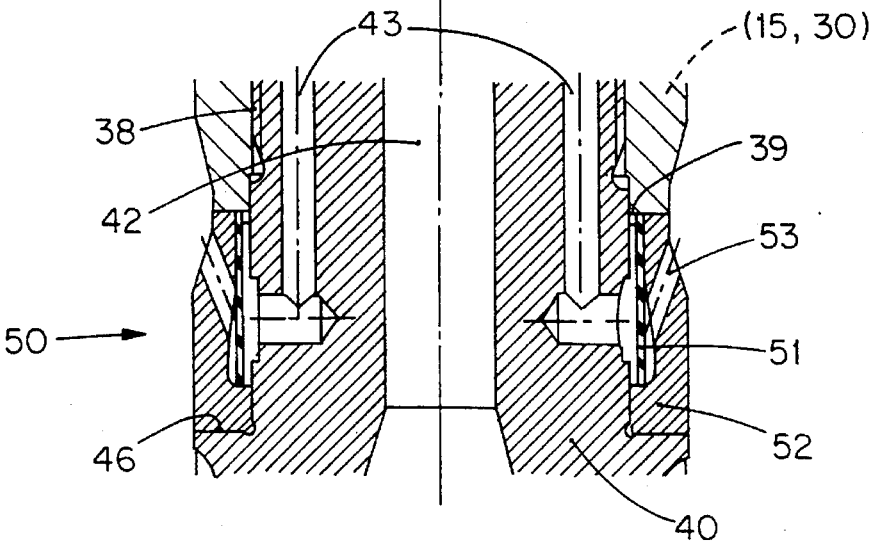
Fig. 5d

PNEUMATIC DRILL HAMMER

SPECIFICATION

The invention relates to a pneumatic drill hammer, in particular a downhole percussion hammer according to the generic portion of claim 1.

Conventional drill hammers of this type include at their foot portion a drill steel having passages for compressed air that is turned around at the borehole bottom and discharges the drillings upwardly. For instance according to DE-A-2 705 191, a downhole hammer comprises a central tube for guiding a ram above which is a sleeve valve with transverse passages for controlling the pressure conditions in the hammer as well as its blowout; such a design is comparatively expensive. It has also been proposed to have the ram slide in a case fixed inside an outer tube, but that may pose problems and is prone to technical trouble. Much the same holds for drill hammers as disclosed in DE-B-2 062 690 and in EP-A-0 484 672.

A drill hammer of the type initially mentioned is described in DE-U-9 202 336. Being well suited even for difficult mining work, this hammer includes a rotatory tubular body for proportioning the blowing air and further includes a shaft which has a central passage and is shiftable inside the tubular body. Together with the latter or with a sleeve component, the lower shaft end forms a shut-off device such as a rotary or parallel slide valve for opening or—possibly in part only—for closing an air deviating volume, as may be required. However, a neck of the shaft that is drivingly connected with the tubular body and a tube head having a plurality of peripheral bores may be fragile due to relatively weak cross sections, the more so since in operation, the full drill hammer length will be effective with a large lever arm.

It is a general objective of the invention to provide a drill hammer of the type mentioned above which is of simple design and can be economically manufactured. The invention further aims at a hammer of high performance combined with a long service life. Yet another objective consists in creating a hammer of such structure that it will operate smoothly and with low compressed air demand even at increased percussion frequencies.

The principle of the invention is stated in the characterizing portion of claim 1. Developments form the subject matter of the remaining claims.

With a pneumatic drill hammer, in particular a downhole percussion hammer, including of an upper end for connection to a compressed air supply and possibly to a drill string, of an outer tube, of a central tube which has radial passages, is arranged downstream of a check valve and is rigidly attached to a control casing jacket, and of a drill steel shiftably retained at the lower end of the outer tube, a head portion of the drill steel being adapted to slide onto a lower end of the central tube that thereabove guides a ram also guided in a cylinder liner, the invention as characterized in claim 1 provides for the cylinder liner and the control casing jacket to be at least in part positively fitted to the outer tube so as to form a rigid assembly therewith. This results in substantial advantages compared to earlier designs where attachment problems frequently caused hammer failures with ensuing operational trouble or breakdown. A drawback was that the outer tube had to be made of two or more parts whereas the invention allows for a single homogenous outer tube, warranting a high degree of working reliability.

According to claim 2, a lower end of the cylinder liner joins, with identical diameter, a shoulder in the outer tube and is concentrically fixed to the control casing jacket, e.g. by lodging the lower end of a tubular body, whereby the cylinder liner is firmly secured in a centered manner.

In the embodiment of claim 3, the tops of the outer tube and of the control casing jacket are trim flush and are peripherally welded without welding fillers, especially along an axial range (welding zone S, length l) with the ratio between the welding zone length and the outer diameter of the outer tube being in the range of 1:1.5 to 1:1.8.

Outer flutes as defined by claim 4 permit the application of screwing tools which, compared to the common clamping jaws, is quite advantageous for practical handling.

The design according to claims 5 to 8 comprises staggered outer ribs on portions of the cylinder liner for easing the air flow and, at the same time, securely bearing on the outer tube. If they extend parallel to a longitudinal hammer axis and are structured in uniform ring arrays in such manner that the peripheral distance between neighboring outer ribs amounts to a multiple of the rib width, there are wide free cross sections in the space towards the outer tube whereby the hammer operation is enhanced. Air distribution is further promoted by interstitially staggering axially subordinated ring arrays of outer ribs that engage the outer tube inside and, at the same time, allow for partial flow in a peripheral direction. The ring arrays may be spaced by axial distances of the order of the rib length so that balancing interchambers are formed which contribute to an even air flow.

An important improvement for which independent protection is sought comprises, according to claim 9, directly joining the top of the control casing jacket to the screw head or to a lower portion of an adapter by a threading that extends parallel to the welding zone essentially along the latter's axial length or beyond it. Due to the safe fit, such an adapter permits using the drill hammer under most variegated conditions of operation with a maximum service life.

In accordance with claim 10, the adapter includes downstream channels that open out towards a ring strainer held by a filter ring which engages an adapter shoulder and, by claim 11, comprises uniformly spaced and upwardly extending peripheral openings such as bores, nozzles, etc. that open out obliquely or curvedly towards an upper outer region where the filter ring is tapered, preferably with a conically reentering portion. Thus there are, so to speak, turning vanes in a blowing ring for generating suction in the way of a jet blast pump whereby the drillings are continuously blown up and out.

Permanent stability of the drill hammer is further assisted according to the important feature of claim 12 that a rotatory sleeve is engaged between the adapter and the screw head, the outer diameter of the sleeve equalling that of the outer tube and the sleeve being drive-connected to the adapter either directly or via a shift unit guiding a shaft. Consequently, a very short shaft with two neighboring guide components will do for the power train. In particular, the drive shaft is sleeve-protected at the decisive point immediately below the screw head. In contrast to conventional designs where a deteriorating fixation of the upper hammer portion due to shocks, vibrations, moments of flexion, etc. from the lower hammer end could bring about failures, the novel drill hammer is much more sturdy not only because of its comparative shortness but also since the blowing ring situated on the adpater is directly adjacent to the threaded sleeve.

In the embodiment using a shift unit which, by claim 13, may guide the profiled shaft in a matching slideway of restricted extension, it is further possible to control the air flow distribution in a desired ratio so that air may centrally pass down to the drill steel while a sufficient quantity may be branched for the required blowout. Compressed air is advantageously fed, according to claim 14, via an annular manifold which has passages for blowing air in continuous operation and which is arranged between the screw head and the sleeve. Moreover, the lower end of the shaft may, in accordance with claim 15, include a lead-in opening for a neck at the upper portion of the adapter whereby the latter is involved in air control, too.

A modification specified in claim 16 provides that the lower end of the shaft comprises a control slide valve having passages and annular areas for air control in combination with a collar in the upper portion of the adapter, a transition volume in the shift unit being flow-connected to downstream channels arranged substantially axially parallel in the upper portion of the adapter and at least some passages being flow-connected, in an upper position of the shaft, to the downstream channels. It will be seen that the air control means thus created is both simple and effective. Relatively small expenditure is needed to obtain flow conditions which greatly contribute to economy in both intermittent and continuous hammer operation.

An embodiment as defined by claim 17 includes in the adapter a valve seat for the check valve that is arranged at the control casing jacket and is, together with a valve spring pertaining thereto, supported by a base having channels which extend from a passage to a chamber of the control casing jacket. This structure is both simple and sturdy. Especially in combination with the welding zone by which the outer tube is rigidly joined to the cylinder liner, the valve support by the base immediately adjacent the lower adapter portion has proved its merits. Continuing passages, channels, recesses, etc. serve for suitable air flow towards the drill hammer bottom.

In accordance with claim 18, the tubular body includes radial bores flow-connected via annular recesses with each other and with radial bores in the control casing jacket, the latter bores opening into a jacket chamber. Air feeding for charging the ram is controlled by the number, size, and arrangement of these radial bores and of the recesses associated thereto. Of great advantage in this respect is the jacket chamber which is situated between the outer tube and the cylinder liner and which has a free cross section at least as wide as the most narrow one of the central passages in the main components of drill hammer (claim 19). Such dimensioning will safeguard good air flow against flow resistance that is at least substantially uniform.

Further developments of the air ducts according to claim 20 comprise transverse and/or radial bores in the cylinder liner and the central tube which are associated to each other and are adapted to be opened and closed, respectively, by the moving ram. Important improvements of the hammer operation are achieved by the features of claim 21, whereby from annular recesses, annular grooves or the like near the periphery, there issue channels, grooves, axial bores, etc. of the ram which open towards one of its faces. It is highly advantageous that the passages required can be manufactured in a relatively simple but very accurate manner; again, the number, size and arrangement of the various passages will influence the impact characteristics as desired. Moreover, it is possible to govern the volume of upstream air by the means of claim 22 in a most expedient way such that the ram will be more accelerated during its upstroke while it will be less decelerated during the downstroke, resulting in a high impact frequency and in an increased impact energy arriving on the drill steel.

Figure 1B:
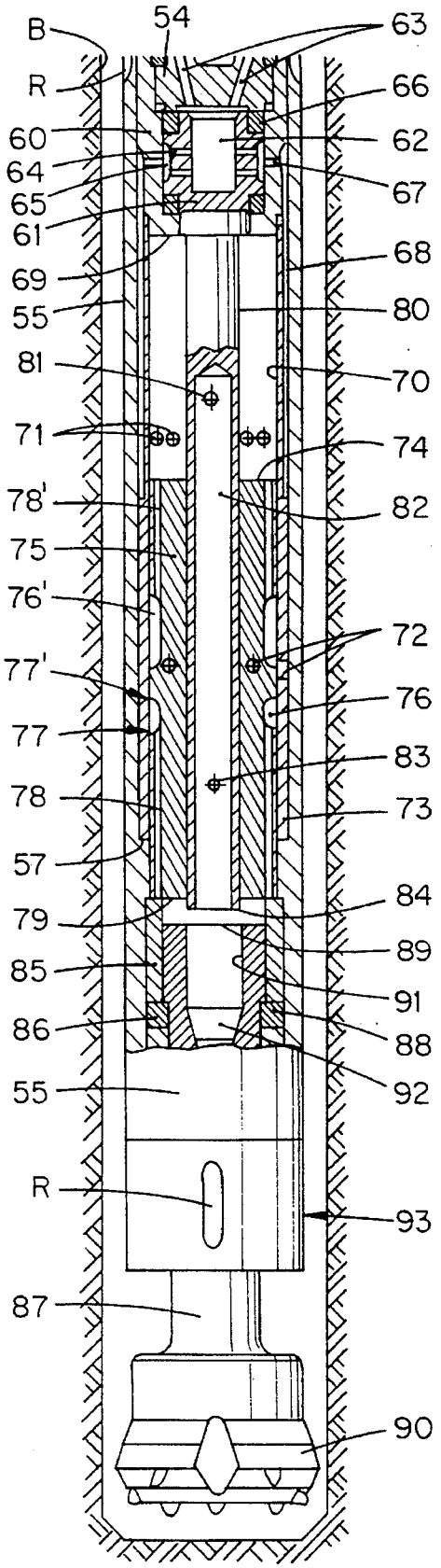
Figure 2A:
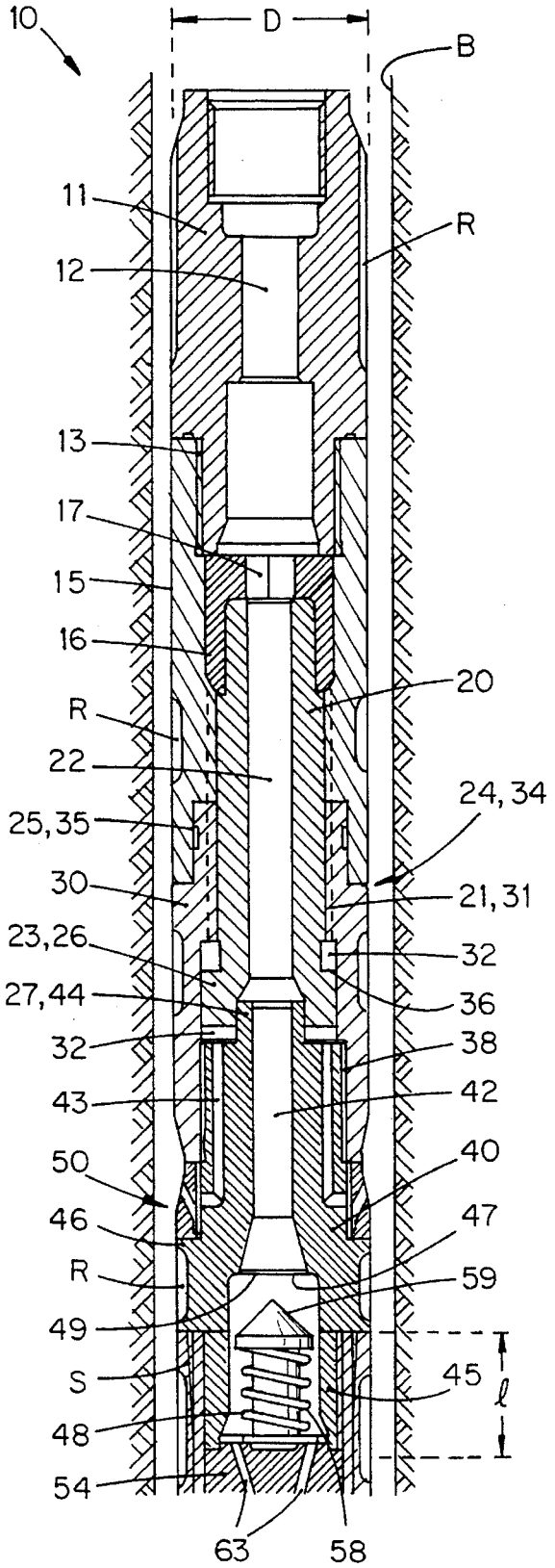
Figure 2B:
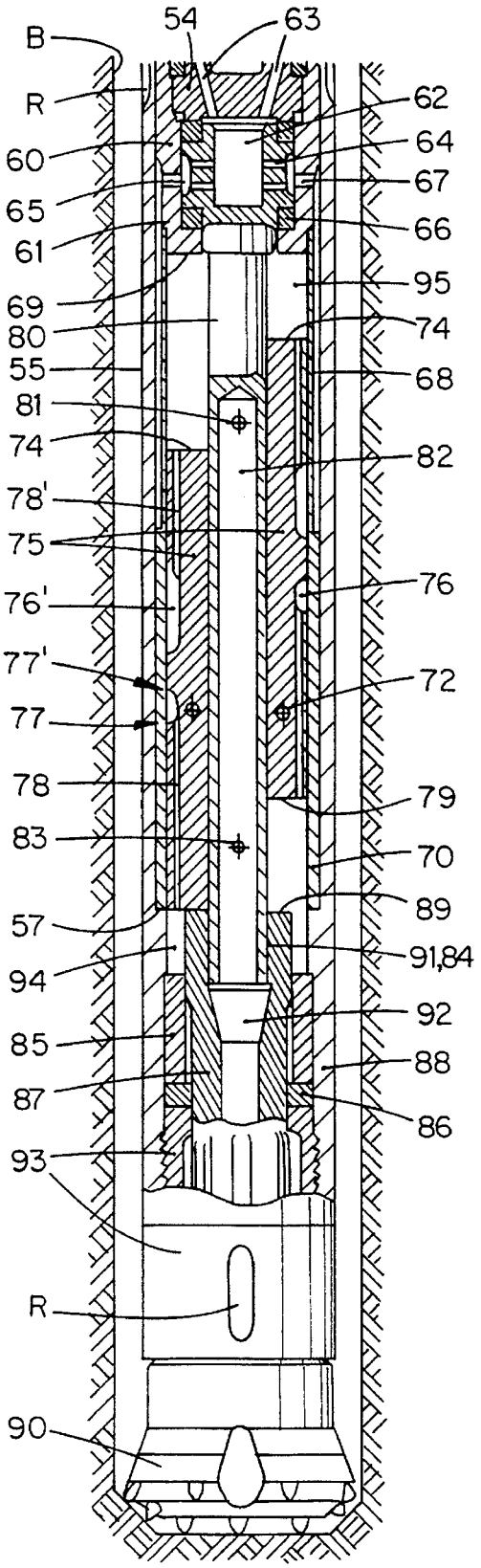
Figure 3:
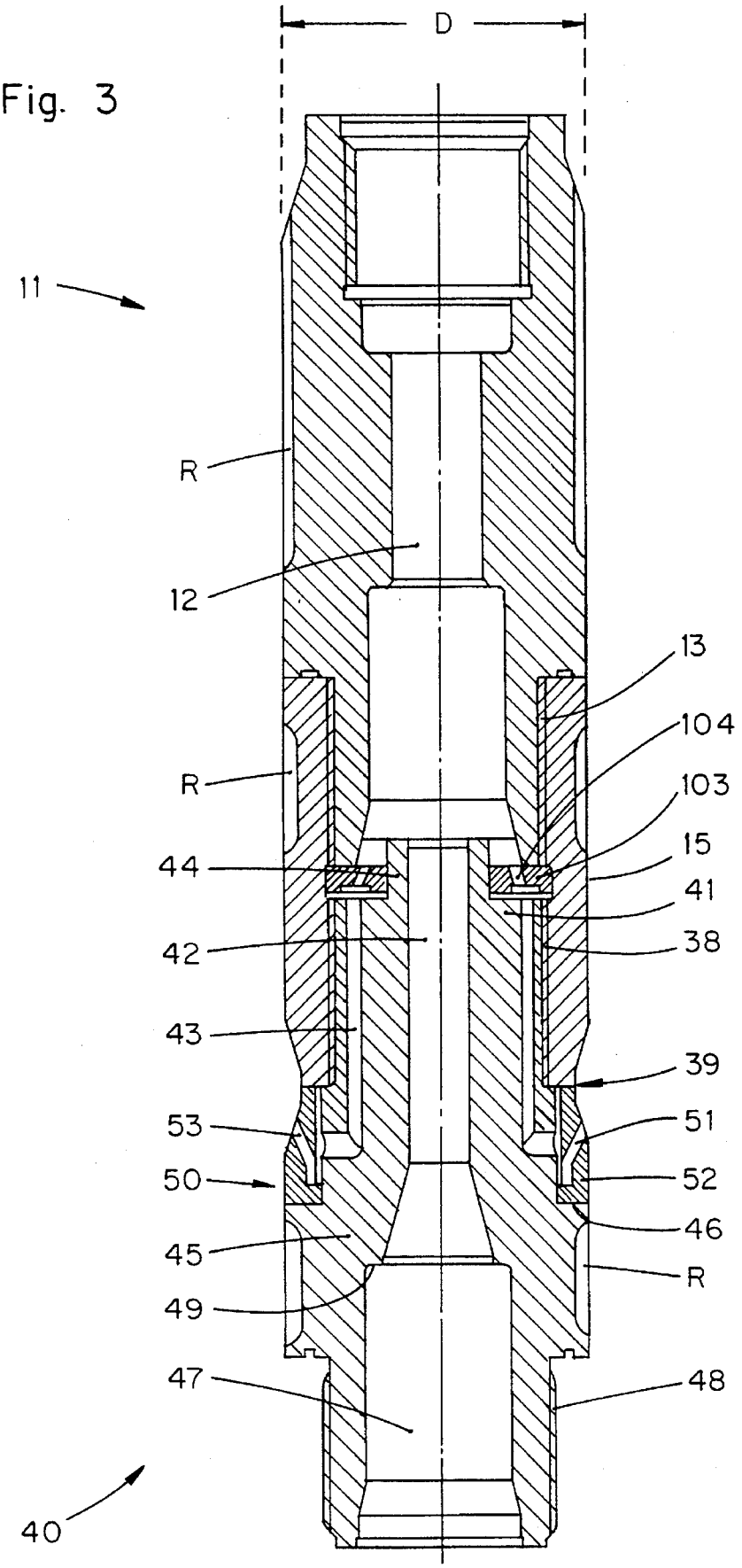
Figure 4:
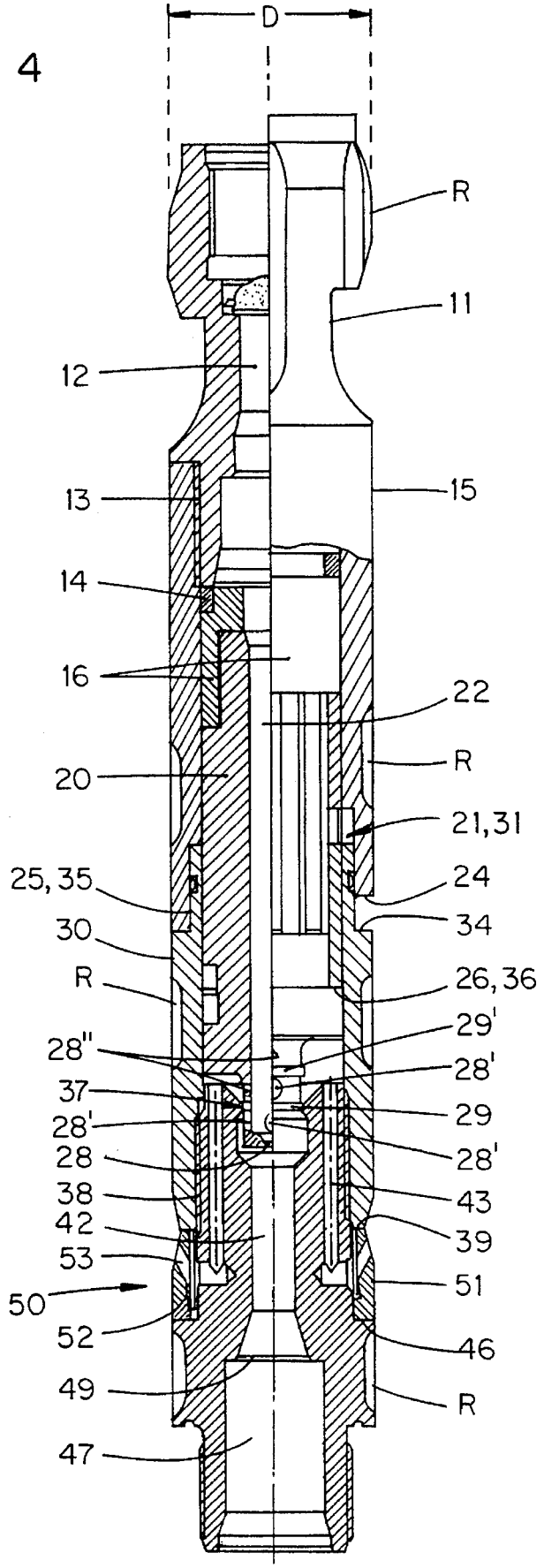
Figure 6:
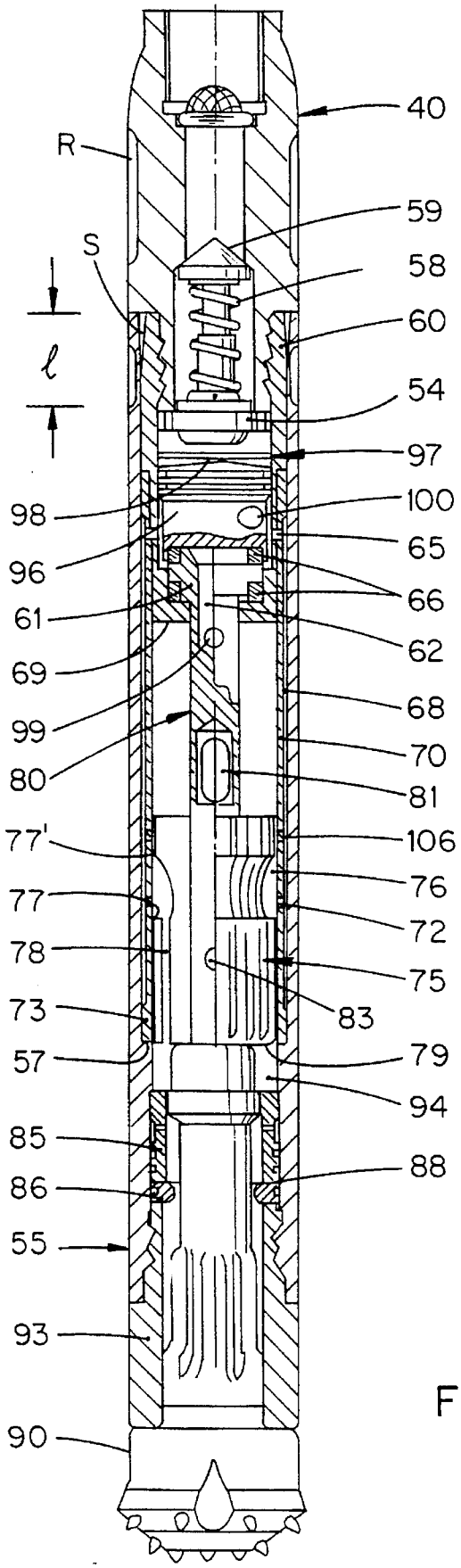
Figure 7:
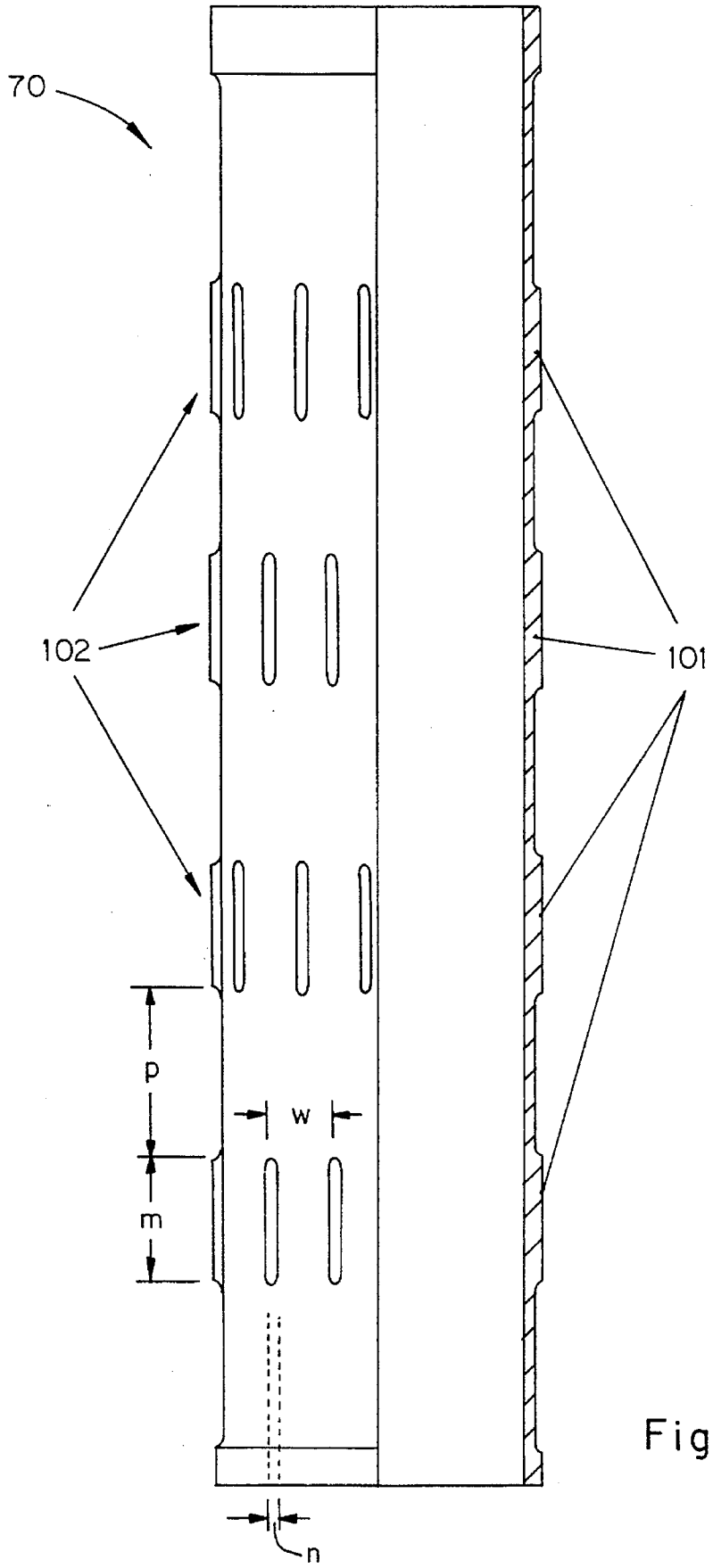
Figure 8C:
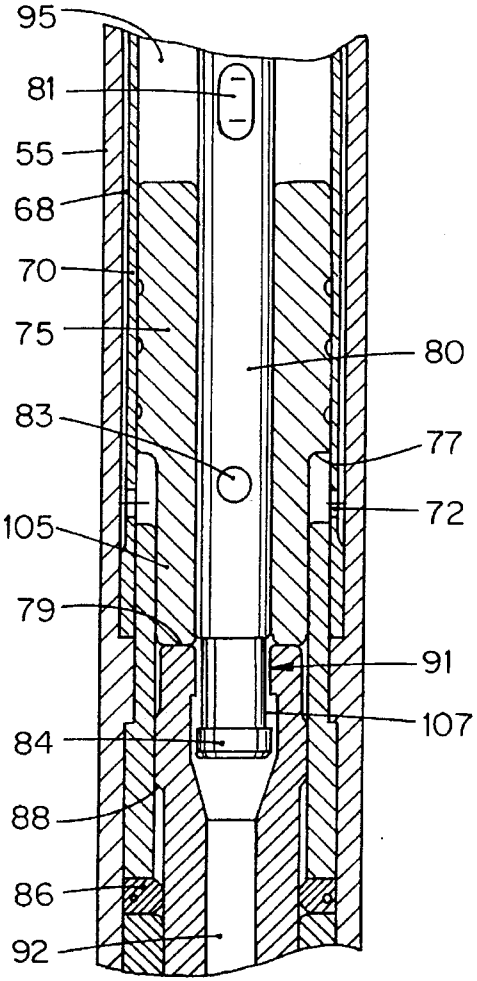
Figure 8B:
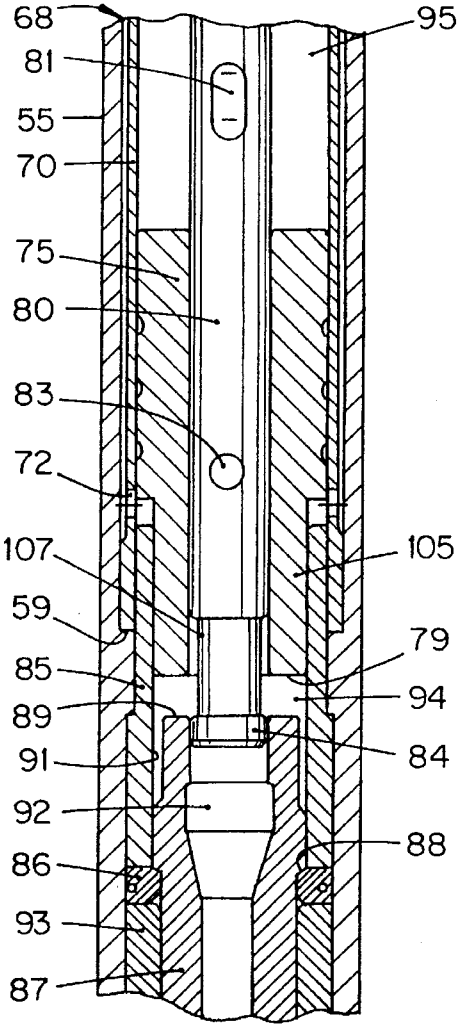
Figure 8A:
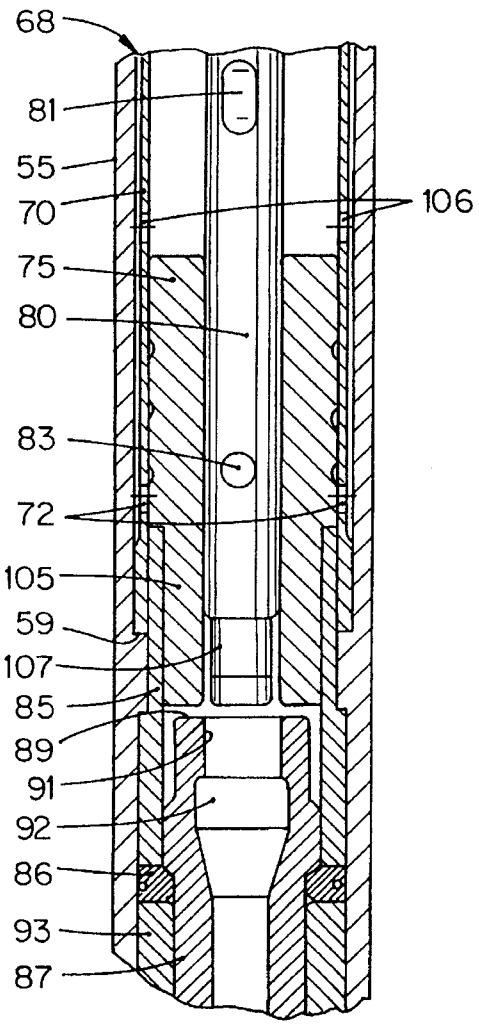

Further features, particulars and advantages of the invention will become apparent from the wording of the claims and from the following elucidation of embodiments shown in the drawings wherein FIGS. 1*a*–1*b* are a longitudinal section through a drill hammer in its blowout position, FIGS. 2*a*–2*b* are a divided longitudinal section through a drill hammer in two different operational positions, FIG. 3 is a longitudinal section through the upper portion of a drillhammer of simplified design, FIG. 4 is a longitudinal section through the upper portion of another drill hammer embodiment in two operational positions, FIGS. 5*a* to 5*d* are lateral and sectional views, respectively, of blowing collar components and its assembly, FIG. 6 is a longitudinal section through a central and lower portion of yet another drill hammer embodiment, FIG. 7 is an axial section and lateral view of a cylinder liner and FIGS. 8*a* to 8*c* are partial longitudinal sectional views of further variants with different ram positions.

The drawings of FIG. 1*a* and FIG. 1*b* are meant to be joined and together form FIG. 1; likewise, FIG. 2*a* and FIG. 2*b* should be joined to commonly form FIG. 2. They show a drill hammer 10 having a screw head 11 and a central passage 12, a threading 13 followed by a seal ring 14 and a tapped sleeve 16 within a sleeve 15 that guides a shaft 20. A shaft head 19 is screwed to the tapped sleeve 16; a central passage 17 is hexagonally shaped for receiving a screwing tool (not shown). The shaft 20 is provided with a spline-type rib profile 21 that positively fits a matching counter-rib profile 31 in an upper portion of a shift unit 30.

A central passage 22 leads down to a lower end 23 of the shaft 20 where there is a shoulder 26 and, inside, a lead-in opening 27. A slideway 25 at a lower end 24 of sleeve 15 guides a neck 35 of shift unit 30. The latter as well as sleeve 15 and screw head 11 are provided with outer flutes R for receiving a screwing tool (not shown). The lower end 24 of sleeve 15 is opposite a shoulder 34 of shift unit 30 which comprises, in addition, an inner stop 36 opposite to the shoulder 26 of shaft 20.

Downwards, there is in the shift unit 30 a transition volume 32 joining an upper portion 41 of an adapter 40 so that a flow connection is provided to a central passage 42 therein and to outer downstream channels 43. The upper portion 41 includes an upwardly extending neck 44. A blowing collar 50 whose structure is seen from FIGS. 5*a* to 5*d* is located at a shoulder 46. Between screw head 11 and upper portion 41, sleeve 15 encompasses an annular space where an annular manifold 103 (FIG. 3) may be situated that has passages 104 for continuous blowing operation.

In a central portion of adapter 40, its passage 42 widens conically for transition to a chamber 47 whose top is designed as a valve seat 49. While there is a threading 38 for screwing the upper portion 41 to the shift unit 30, another threading 48 at the lower portion 45 serves for connection to to an outer tube 55 which—like the adapter 40—is provided with outer flutes R.

At its upper portion 56, outer tube 55 is welded to a control casing jacket 60 in a welding zone S of an axial length l that roughly corresponds to the length of threading 38. The lower portion 45 of adapter 40 abuts on a base 54 which is a support for a check valve 59 with valve spring 58 and which includes channels 63 opening out to a chamber 62 of a central tube 80.

The control casing jacket 60 has radial bores 64 that may be offset relative to each other in axial and peripheral directions. They open out in an annular recess 65 that is flow-connected via radial bores 67 to a jacket chamber 68 situated between a cylinder liner 70 and the unit of outer tube 55 and control casing jacket 60 welded at its upper end. Jacket chamber 68 terminates at a step 57 of outer tube 55 and comprises upper radial bores 71 as well as central radial bores 72 that function as an inlet port.

Inside conctrol casing jacket 60, there is a tubular body 61 continued by the central tube 80 which has transverse bores 81 in an upper region and radial bores 83 in a lower region. Immediately above lower end 84 of central tube 80, it is provided with a recessed portion 107 of smaller outer diameter (see FIGS. 8*a*, 8*b*, 8*c*), but a uniform central tube 80 is also possible (FIGS. 1*b*, 2*b*). In either case, tube 80 guides a ram 75 that is also guided in the cylinder liner 70, has annular recesses 76, 76' and comprises axial bores 78, 78'. A top face 74 of ram 75 is opposite a bottom face 69 of tubular body 61; a bottom face 79 of ram 75 is to hit periodically on an opposite impact face 89 of a drill steel 90.

Drill steel 90 includes a shaft 87 having a shoulder 88 held by a support ring 86. A bumper sleeve 85 guides shaft 87 at an upper portion thereof. A passage 92 is shaped as a lead-in bore 91 towards impact face 89 and coacts with the central tube 80 for air control, the lower end 84 being recessed (as described) for the purpose. Drill steel 90 further comprises a support unit 93 having outer flutes R. In conventional fashion, the foot portion of drill steel 90 is provided with passages and pins or carbide tips (not designated).

The lower portion of drill hammer 10 is seen in FIG. 1 in its elevated blowout position, i.e. clear of the ground in borehole B with the drill steel 90 being suspended. In the upper hammer portion, shoulder 26 of lower shaft end 23 engages stop 36 of shift unit 30 so that neck 44 of adapter 40 is free. Air fed through central bores 12, 22 of screw head 11 and shaft 20, respectively, is branched to that a partial flow goes through passage 42 of adapter 40 and presses on check valve 59 moving it into an open position (FIG. 1); the remaining air flow passes through the downstream channels 43 of adapter 40 and through ring strainer 51 as well as nozzles or slanted bores 53 of blowing collar 50. The turn of the air flow generates a Venturi effect causing suction in the way of a jet blast pump so that the drillings are drawn up from the borehole bottom and blown out. The partial or branched flow quantities can be proportioned as required by selecting the number and size of the passages, channels, bores, etc.

In its blowout position (FIG. 1), drill hammer 10 is lifted off the ground whereby drill steel 90 is supported under upstream air and its shoulder 88 is suspended on supporting ring 86 while bumper sleeve 85 is engaged by ram 75 whose top face 74, therefore, is below the radial bores 71 of cylinder liner 70. Thus compressed air flows through channels 63 into chamber 62 of central tube 80 and via bores 64/65/67 into jacket chamber 68, along outer tube 55 towards the radial bores 71 and into axial bores 78 but also through transverse bores 81 and central bore 82 in shaft 87 of drill steel 90 so as to blast the borehole bottom.

In the working position shown in FIG. 2, lower shaft end 23 in the upper portion of drill hammer 10 encompasses neck 44 of adapter 40, and shoulder 26 shuts off the downstream channels 43. Compressed air fed will pass through all the central bores and passages 12, 22, 42/47, 62, 82, 92 of the main hammer components 11, 20, 20, 40, 61, 80, 87/90 so that drill steel 90 hammers onto the borehole ground. For continuous blowout, partial flow quantities may be branched towards blowing collar 50 by suitably dimensioning or adjusting an annular gap between neck 44 of adapter 40 and shoulder 26 of shaft 20 so as to obtain a slide valve action.

At the same time, the lower portion of drill hammer 10 is in its working position (FIG. 2*b*, left) with the drill steel 90 impacting the borehole bottom while ram 75 is elevated so that its top face 74 is above the radial bores 71 thus shut off. The top of drill steel shaft 87 encloses the lower end 84 of central tube 80 so that a closed volume 94 is formed above bumper sleeve 85. Upstream air will enter the closed volume 94 through axial bores 78 from the lower annular recess 76 of ram 75. The latter will move upwards until the upstream air is shut off when lower control edge 77 has passed the radial bores 72 of cylinder liner 70 (FIG. 2*b*, right). During the upstroke, air above ram 75 is exhausted through the transverse bores 81 of central tube 80.

When the top face 74 of ram 75 has risen above the level of the transverse bores 81 and, consequently, below the bottom face 69 of control casing jacket 60 a buffer volume 95 has formed, this will be air-loaded so as to reduce the speed of ram 75 during its upstroke. At that point, bottom face 79 has released the radial discharge bores 83 of central tube 80 whereby air relief is obtained.

As soon as the upper control edge of annular recess 76' passes beyond the radial bores 71 of cylinder liner 70, compressed air will flow through axial bores 78' into the buffer volume 95 whereby the impacting downstroke of ram 75 is initiated. Air feeding continues until the upper control edge of annular recess 76' has sunk below the radial bores 71 (FIG. 2*b*, left) so that they are shut off. During the downstroke, air retained below ram 75 is exhausted through the radial bores 83 of central tube 80 until these are shut off as the bottom face 79 of ram 75 passes by. The next working cycle will begin when the closed volume 94 is regenerated.

FIG. 3 represents the upper portion of a drill hammer embodiment that is simplified by omitting shaft 20 and shift unit 30. Sleeve 15 attached to screw head 11 is directly screwed to adapter 40 via threading 38. Compressed air is fed through annular manifold 103 and its passages 104 through the passages 12, 42 towards the lower hammer portion (not shown here). Again, blowout is effected through the downstream channels 43 and the bores 53 of blowing collar 50, with the ratio of branched air quantities being determined by the number and dimensions of the passages, channels, bores, etc.

In the variant of the upper hammer portion shown in FIG. 4, lower end 23 of shaft 20 acts as a slide valve vis-à-vis e.g. two annular areas 29, 29' and a number of neighboring passages 28, 28', 28". in the elevated position of the drill hammer 10 (FIG. 4, left), the upper annular area 29' will shut off the top of passage 42 in adapter 40 so that the total air flow will pass into the lower hammer portion screwed on (not shown here) through the passages 12, 22, 28'/28, 42 of the components 11, 20/23, 40.

In contrast to the intermittent operation of the preceding hammer embodiments whose drill steel 90 is lifted off the borehole ground and thus stops impacting but blasts the borehole B, the slide valve design of FIG. 4 will, in combination with the embodiments shown in FIGS. 8*b* and 8*b*, ensure continuous operation in a surprisingly simple mode with exactly metered partial air quantities. Here, ram 75 will continually oscillate even when the drill hammer 10 is lifted, producing jolts and vibrations that are desirable for some rock formations and else may be essential, such as with overburden, salvage, cleavage, fissures, etc. By suitably reducing the air branched into the lower hammer portion in the slide valve section (23/41), the ram stroke as well as the impact energy may be sufficiently reduced in order to avoid excessive stress on the drill hammer 10 so that its self-destruction is definitely prevented.

The remaining partial air quantities will exhaust through the downstream channels 43 in adapter 40 and through the bores or nozzles 53 of blowing collar 50, warranting the free blowout up along borehole B. If that is to be intensified, the annular space between the collar 37 and the areas 29, 29' of the slide valve section (23/41) may be widened in proportion to the partial air throughput desired. Optionally or in addition, other passages 28" of suitable size may be provided above the upper annular area 29'.

As the drill steel 90 is suspended (FIG. 4, right), the air flow fed through passage 22 will be branched so that downstream air will partly exhaust to ambience through the passages 28', 43, 53 while a partial quantity will flow down into the lower hammer portion through the bottom passage 28 and a narrow annular space present between ring area 29 and collar 37. Again, branching ratios may be arranged for as required by suitably dimensioning the passages, channels, bores, etc.

Another version of the drill hammer 10 featuring valve control and adjustable upstream air is shown in FIG. 6 where like components are identified by the same reference symbols as hereinabove. The design again comprises a central tube 80 but includes a cylinder liner 70 having outer ribs 101 and a control valve 97 in a control casing jacket 60 axially welded to the outer tube 55. If the hammer 10 is lifted off the borehole ground, the bottom face 79 of ram 75 will engage the bumper sleeve 85. As soon as the hammer is pressed to touch ground, the drill steel 90 will lift the ram 75 and once the upper control edge 77 of its annular recess 76 passes the radial bores 72 of cylinder liner 70, upstream air will flow through the axial bores 78 into the closed volume 94 below ram 75 which, therefore, is moved upwards. During this upstroke, ram 75 will exhaust air above its top through the transverse outlet bores 81 of central tube 80. When the top face 74 of ram 75 has passed the upper edge of the transverse outlet bores 81 and the bottom face 79 has passed the radial bores 83, the volume 94 will open whereby valve 97 switches to release compressed air for impacting.

FIG. 6 displays a flapper-type control valve 97 in a neutral position; other valves, however, can also be employed. A flap is borne on a central support, e.g. a prism 98, on top of control casing 96. If the flap tilts (to the right in FIG. 6), a lefthand passage (not shown) will open and air can flow through bores (not shown) in control casing 96 into chamber 62 of central tube 80 and, via bores 99, into the space between top face 74 of ram 75 and bottom face 69 of control casing jacket 60. As the ram 75 goes down, the pressure above it will decrease when its top face 74 passes the upper edge of the transverse outlet bores 81 in central tube 80. After the lower control edge 77 of ram 75 has passed the radial bores 83 of central tube 80, air is released so the flap tilts (to the left in FIG. 6), shutting off the impacting ducts and simultaneously opening the upstroke bores (not shown) in control casing 96 which lead to collect bores 100. From there, the air will flow through annular recess 65 and radial bores 67 into a jacket chamber 68 that is between cylinder liner 70 and outer tube 55. Finally the air will pass through radial bores 72 of the cylinder liner 70 into the recess 76 of ram 75 and will thus initiate a new cycle of operation.

It is important to note that the novel drill hammer 10 provides control via the central tube 80 irrespective of the axial extension of ram 75. This results in high impact frequency on account of the full upstream air pressure acting on the large bottom face 79, and in fast upward acceleration. By contrast, conventional drill hammers having a ram either without bore or, if with bore, without a central tube have only a relatively limited space for upstream air and are designed for high energy of each impact so that the hammering frequency is rather low. According to the invention, it is possible to have the ram 75 shut off the inlet port bores 72 e.g. at about one third of the upstroke way. Once the upstream flow is cut off, there will be a decrease of pressure in volume 94 and when ram 75 goes down into that space, it will displace much less air than if the volume had been loaded throughout the entire upstroke. As a consequence the down-going ram 75, too, will receive higher acceleration and land more energy onto the drill steel 90 due to less retardation.

A modified embodiment (not shown) comprises a solid ram without outer axial bores, annular grooves, etc. but with the inlet port 72 being so low that upstream air flowing when the drill steel 90 touches ground will lift the ram 75 from below.

Further drill hammer versions are seen in FIGS. **8*a* to 8*c* where the ram 75 guided on central tube 80 goes down into bumper sleeve 85. No matter how long the ram 75 is, upstream air will be governed by the radial bores 83 in central tube 80**. (By contrast, conventional hammers without a central tube require a ram of great length in order to collect a sufficient quantity of upstream air during its stroke.)

The invention is not limited to the embodiments described but may be modified in many ways. For example, it is possible for economic manufacture of a high strength adapter 40 to replace bores near the periphery by some grooves or flutes at the outside of threading 38 which extend up to the blowing collar 50. FIG. 7 shows a special cylinder liner 70 having a plurality of outer ribs 101 arranged at peripheral distances w in staggered ring arrays 102 of such axial distances p that both great throughflow volume and good support at the inner wall of outer tube 55 are attained. Preferably, the individual ring arrays 102 are interstitially located so that neighboring arrays 102 will be peripherally displaced by, say, half the peripheral rib distance w which is a multiple of rib width n, in particular two to five times as large. The axial distances p may roughly correspond to rib length m but may alternatively be shorter so that the ring arrays 102 will be closer to each other.

Similar to FIG. 6, the embodiment of FIG. **8*a* shows the central portion of a drill hammer 10 for intermittent operation. In the blowout position displayed, ram 75 contacts bumper sleeve 85, shutting off the upstream inlet port 72 but relieving upper blowout bores 106** whereby the hammer operation may be stopped.

FIGS. **8*b* and 8*c* are analogous to FIGS. 4 and 6, showing the central portion of a drill hammer 10 designed for continuous operation. According to FIG. 8*b*, the drill steel 90 is yet in its suspended position with the extended wider end 84 of central tube 80 shutting off the lead-in bore 91 of shaft 87, whereby the upper hammer portion (FIG. 4) will supply a reduced quantity of air. It is expediently apportioned such that the down-going ram 75 will self-produce buffering in the closed volume 94 so that contact between ram 75 and bumper sleeve 85 as well as drill steel 90 will be prevented. The upstream air pressure will move the ram 75 upwards then (FIG. 8*c*) and as soon as it shuts off the outlet bores 81 in buffer volume 95, ram 75** will start oscillating.

It will be realized that according to the invention, the drill hammer 10 generally comprises an outer tube 55, a control casing jacket 60 inclusive of check valve 59 and a central tube 80 having radial passages 81,83. A ram 75 is guided on central tube 80, onto the lower and preferably recessed end 84 of which the head of a drill steel 90 may slide. A cylinder liner 70 that may be provided with outer ribs 101 also guides ram 75 and is peripherally welded to outer tube 55 along a welding zone S of axial length l. Above control casing jacket 60, there is an adapter 40 comprising downstream channels 43 and carrying a blowing collar 50 provided with upwardly directed nozzles 53. A drive-transmitting sleeve 15 below a screw head 11 is joined to adapter 40 either directly or via a shift unit 30 that guides a shaft 20 whose lower end 23 may form a slide valve relative to the upper adapter portion 41. From there, passages 42, 47 lead to a control casing jacket 62 having channels 63. Below a tubular body 61, there is between outer tube 55 and cylinder liner 70 a jacket chamber 68 of a free cross section at least as large as that of the narrowest among the central passages 12, 22, 32, 42/47, 62, 82, 92 in the main components 11, 20, 30, 40, 61, 80, 87/90, respectively. Grooves, channels and bores 71, 72; 81, 83 in cylinder liner 70 and central tube 80 serve, together with recesses 76, 76' and bores 78, 78' for controlling the movement of ram 75.

All features and advantages proceeding from the claims, the description and the drawings, including design details and spatial arrangements, can be substantial to the invention both individually and in a wide veriety of combinations.

I claim:

1. A pneumatic drill hammer, comprising:

a screw head (11) for connection to a compressed air supply;

an outer tube (55);

a central tube (80) which has radial passages (81, 83), wherein the central tube is arranged downstream of a check valve (59) and is rigidly attached to a control casing jacket (60), and a drill steel (90) shiftably retained at the lower end of the outer tube (55), a head portion of the drill steel (90) being adapted to slide onto a lower end (84) of the central tube (80)

wherein, above its lower end, the central tube guides a ram (75) which is also guided in a cylinder liner (70), the cylinder liner (70) and the control casing jacket (60) being at least in part positively fitted to the outer tube (55) so as to form a rigid assembly therewith, wherein tops of the outer tube (55) and of the control casing jacket (60) are trim flush and are peripherally welded without welding fillers along an axial range (welding zone S, length l) with a ratio between the welding zone length (l) and an outer diameter (D) of the outer tube (55) being in the range of 1:1.5 to 1:1.8.

2. Drill hammer according to claim 1, wherein a lower end (73) of the cylinder liner (70) joins a shoulder (57) in the outer tube (55), the shoulder (57) having a diameter substantially identical with a diameter of the lower end (73), the lower end (73) being concentrically fixed to the control casing jacket (60) by lodging the lower end of a tubular body (61).

3. Drill hammer according to claim 2, wherein the tubular body (61) includes a plurality of radial bores (64) and annular recesses (65) in a peripheral surface thereof, said control casing jacket (60) including further radial bores (67) having first openings in a jacket chamber (68) between the outer tube 55) and the cylinder liner (70), said radial bores (64) connected with one another via the annular recesses (65), said radial bores (64) also connected by said annular recesses (65) with second openings of said further radial bores (67) in the control casing jacket (60).

4. Drill hammer according to claim 3, wherein the free cross section of the jacket chamber (68) at least equals that of the narrowest passage among central passages in main components of said hammer, said main components including said screw head (11), a shaft (20), a shift unit (30), an adapter (40), a tubular body (61), said central tube (80), and a shaft and said drill steel (87/90) of the drill hammer (10).

5. Drill hammer according to claim 1, wherein components of said hammer, selected from a group consisting of said screw head (11), a rotary sleeve (15), a shift unit (30), and an adapter (40) have diameters substantially equal to said outer diameter (D) of the outer tube (55) and are provided with outer flutes (R), said outer flutes (R) being provided at an upper portion (56) of the outer tube (55), wherein said outer tube is located substantially in or around the welding zone (S).

6. Drill hammer according to claim 5, wherein portions of the cylinder line (70) comprise staggered outer ribs (101).

7. Drill hammer according to claim 1, wherein portions of the cylinder line (70) comprise staggered outer ribs (101).

8. Drill hammer according to claim 7, wherein the outer ribs (101) have a rib width (n) and a rib length (m), extend parallel to a longitudinal hammer axis and are structured in uniform ring arrays (102) in such manner that a peripheral distance (w) between neighboring outer ribs is a multiple of the rib width (n), said multiple being in a range between two and five.

9. Drill hammer according to claim 8, wherein the ring arrays (102) are spaced by axial distances (p) of the order of the rib length (m).

10. Drill hammer according to claim 8, wherein the multiple is substantially equal to three.

11. Drill hammer according to claim 8, wherein the ring arrays (102) include axially subordinated ring arrays (102) having interstitially staggered outer ribs.

12. Drill hammer according to claim 7, wherein the ring arrays (102) include axially subordinated ring arrays (102) having interstitially staggered outer ribs.

13. Drill hammer according to claim 12, wherein the ring arrays (102) are spaced by axial distances (p) of the order of a rib length (m) of the outer ribs.

14. Drill hammer according to claim 1, wherein the top of the control casing jacket (60) is directly joined to the screw head (11) or to a lower portion (45) of an adapter (40) by a threading (38) that extends parallel to the welding zone (S) substantially at least along the axial length (l) of the welding zone (S).

15. Drill hammer according to claim 14, wherein the adapter (40) includes downstream channels (43) near a periphery of the adapter, said channels having openings and directed outwardly towards a ring strainer (51) held by a filter ring (52) engaging a shoulder (46) of the adapter (40).

16. Drill hammer according to claim 16, wherein the filter ring (52) has an upper outer tapered region, and comprises uniformly spaced and upwardly extending peripheral openings directed outwardly towards the upper outer tapered region.

17. Drill hammer according to claim 16, wherein the upper outer tapered region of the filter ring (52) has a conically reentering portion, and wherein the uniformly spaced and upwardly extending peripheral openings comprise nozzles (53) directed obliquely or curvedly towards the upper outer tapered region.

18. Drill hammer according to claim 14, further comprising a rotatory sleeve (15) engaged between the adapter (40) and the screw head (11), the sleeve (15) having an outer diameter substantially equalling the outer diameter (D) of the outer tube (55), and wherein the sleeve (15) is drivingly connected to the adapter (40).

19. Drill hammer according to claim 18, wherein the sleeve (15) is connected to the adapter (40) via a shift unit (30).

20. Drill hammer according to claim 19, wherein the shift unit (30) comprises a slideway (25) of restricted extension for guiding a shaft (20) therein, said shaft (20) having a rib profile (21), said sleeve (15) having a counter-rib internal profile (31) matching the rib profile (21) of the shaft, a neck (35) of the shift unit (30) being slideable in the sleeve (15) along the matching counter-rib profile (31), and wherein the shaft has a shoulder (26) opposite a stop (36) of the shift unit (30).

21. Drill hammer according to claim 18, wherein an annular manifold (103) having passages (104) for blowing air in permanent operation is arranged between the screw head (11) and the sleeve (15).

22. Drill hammer according to claim 18, wherein a lower end (23) of the shaft (20) includes a lead-in opening (27) for a neck (44) at an upper portion (41) of the adapter (40).

23. Drill hammer according to claim 18, wherein the lower end (23) of the shaft (20) comprises a control slide valve having passages (28, 28', 28") and annular areas (29, 29') for air control in combination with a collar (37) in the upper portion (41) of the adapter (40), wherein a transition volume (32) in the shift unit (30) is in fluid communication with downstream channels (43) arranged substantially axially parallel in the upper portion (41) of the adapter (40) and wherein in an upper position of the shaft (20), at least some passages (28', 28") are flow-connected to the downstream channels (43).

24. Drill hammer according to claim 14, wherein:

control casing jacket (60) includes therein a base unit (54), said base unit having channels (63) extending within the control casing jacket (60) from a passage (42) thereof to a chamber (62) thereof;

adapter (40) comprises a valve seat (49) for a check valve (59); and said base unit (54) supports said valve seat (49), together with a valve spring (58) pertaining thereto, in the control casing jacket (60).

25. Drill hammer according to claim 1, wherein the cylinder liner (70) and the central tube (80) comprise bores (71, 72; 81, 83) adapted to be opened and closed, respectively, by a moving ram (75).

26. Drill hammer according to claim 25, wherein said moving ram (75) comprises substantially radial faces (74, 79), annular recesses (76) near a peripheral surface thereof and axial bores (78, 78') extending from said annular recesses (76) towards one of said radial faces (74 and 79).

27. Drill hammer according to claim 25, wherein the bores (71, 72; 81, 83) have dimensions for enabling the moving ram (75) in combination with a control valve (97) to close an upstream inlet (72) at a predetermined portion of a return stroke of the ram.

28. A downhole percussion hammer, comprising a drill hammer in accordance with claim 1.

* * * * *